US006807391B2

(12) United States Patent
Payne et al.

(10) Patent No.: US 6,807,391 B2
(45) Date of Patent: Oct. 19, 2004

(54) THERMALLY ACTIVATED SEALING APPARATUS AND METHOD

(75) Inventors: David M. Payne, Star, ID (US); Tim Hoberock, Boise, ID (US); Troy Jensen, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/356,785

(22) Filed: Jan. 31, 2003

(65) Prior Publication Data

US 2004/0151517 A1 Aug. 5, 2004

(51) Int. Cl.[7] ..... G03G 15/08
(52) U.S. Cl. ..... 399/106; 399/103
(58) Field of Search ..... 399/102, 103, 399/106, 258, 260, 262, 263; 49/1, 2; 222/54, DIG. 1

(56) References Cited

U.S. PATENT DOCUMENTS 3,596,800 A * 8/1971 Iketani ..... 222/54
3,984,942 A 10/1976 Schroth
4,354,452 A 10/1982 Patterson
4,432,609 A * 2/1984 Dueker et al. ..... 49/2 X
4,905,344 A * 3/1990 McCabe ..... 49/2 X
4,937,628 A * 6/1990 Cipolla et al. ..... 399/106
5,133,487 A * 7/1992 Russi ..... 222/54 X
5,799,712 A 9/1998 Kelly et al.
5,839,027 A * 11/1998 Sahay et al. ..... 399/106
6,546,216 B2 * 4/2003 Mizoguchi et al. ..... 399/106

* cited by examiner

*Primary Examiner*—Sandra Brase

(57) ABSTRACT

Apparatus include a thermally activatable sealing member. The sealing member can be operatively positioned in or near an opening or passage to control the flow of material therethrough by way of selective thermal activation of the sealing member. Methods include providing a thermally activatable sealing member in or near an opening or passage and selectively thermally activating the sealing member to control the flow of material through the opening or passage.

31 Claims, 10 Drawing Sheets

THERMALLY ACTIVATED SEALING APPARATUS AND METHOD

BACKGROUND OF THE INVENTION

Various types of imaging devices are known in the art. Presently, one of the more popular types of imaging devices is that known as the electrophotographic imaging device which is commonly called a "laser printer." The fundamental operation of the electrophotographic imaging device is well understood in the art and includes providing a photoconductive surface often in the form of a rotatable drum. A laser, or other suitable light source, is selectively pulsed as it is directed at the moving photoconductive surface.

The selective pulsing of the light source as it is directed at the photoconductive surface causes the formation of the desired image on the surface in a latent, electrostatic form. A dry, powdered ink substance, known as "toner," is then applied to the photoconductive surface to "develop" the image, wherein the toner adheres essentially only to the latent image on the surface. The developed image, in the form of toner, is ultimately transferred from the photoconductive surface to a carrier media, such as a sheet of paper, and is affixed thereto.

Most conventional electrophotographic imaging devices include one or more reservoirs for containing a supply of the powdered toner. Generally, the toner reservoir is in the form of an enclosed hopper-like container having an opening through which the toner is dispensed during operation of the respective imaging device. In many cases, the toner reservoir is incorporated into a "toner cartridge" which contains a given quantity of toner. The toner cartridge is designed to be conveniently removed from the imaging device when the toner is depleted. A like cartridge having a full supply of toner can then be replaced into the imaging device. As can be appreciated, the "replaceable toner cartridge" concept facilitates efficient operation of the imaging device by reducing down time due to toner depletion.

Many conventional toner cartridge configurations employ a temporary sealing device referred to as a "toner dam." The general purpose of the toner dam is to prevent toner from coming out of a full toner cartridge before the cartridge is installed into the imaging device. For example, without a toner dam, toner could inadvertently come out of a full toner cartridge during handling and shipment thereof, with undesirable results. The toner dam is generally installed during manufacture, or remanufacture, of the toner cartridge. Toner dams are described in greater detail in U.S. Pat. No. 5,799,712 to Kelly et al.

User instructions are usually provided on the toner cartridge packaging, and/or by other convenient means, which explain to the end-user how and why the toner dam should be removed from the cartridge prior to installation of the cartridge into an imaging device. However, as is the case with regard to nearly any product, the installation instructions go unheeded in a significant number of instances. The primary result of failing to remove the toner dam upon installation of the toner cartridge is, of course, that the imaging device will not function properly, if at all.

As can be expected, a secondary result of failing to remove the toner dam is that the end-user becomes frustrated due to the failure of the imaging device to function properly. This, in turn, often results in the end-user calling the manufacturer of the device, and/or the sales agent, to report an apparent malfunction of the imaging device. The manufacturer, and/or the sales agent, thus oftentimes incurs unnecessary expenses in connection with resolving the issue of the alleged "malfunctioning" device.

Furthermore, as is discussed in U.S. Pat. No. 5,799,712, empty toner cartridges are often recycled by refilling them with toner at specially equipped facilities. However, the reinsertion of a toner dam into a previously used toner cartridge can be a relatively significant undertaking, accounting for a correspondingly significant proportion of the cost of recycling a given toner cartridge.

Additionally, problems are associated with the transport or movement of imaging devices with toner cartridges installed. More specifically, the transport or movement of an imaging device having a toner cartridge installed therein with the toner dam removed therefrom can generally result in damage to the device due to toner coming out of the cartridge. Therefore, it can be desirable to provide a toner cartridge having a sealing device which can alleviate the problems associated with the conventional toner dam as explained above.

More generally, various sealing devices are known in the art. For example, U.S. Pat. No. 3,984,942 to Schroth discloses an inflatable seal which can be employed to seal vehicle doors and the like. Such seals generally include a pliable inflatable member that can be filled with pressurized fluid, thereby causing expansion of the inflatable member. The expansion of the inflatable member, in turn, creates a sealing effect when the inflatable member is disposed between a door and a perimeterical doorframe, for example.

Similar inflatable members have been employed in various production devices and the like as is disclosed by U.S. Pat. No. 4,354,452 to Patterson. More specifically, Patterson discloses an edge dam which includes an inflatable member, wherein the edge dam is employed in an applicator for applying a coating liquid to a moving web of paper carried on a backing roll. While such inflatable members are known to function satisfactorily, such inflatable members are not generally well suited for providing a seal in place of the toner dam in toner cartridges.

This is because such inflatable members generally require a volume of working fluid such as air or hydraulic oil, as well as a pressurization/conveyance system for pressurizing the working fluid and conveying the fluid to and from the inflatable member. Such systems are thus generally too complex and too large for the application at hand.

SUMMARY OF THE INVENTION

In accordance with one embodiment of the present invention, an apparatus includes an object that defines an opening through which a material can selectively flow. The apparatus also includes a thermally activated sealing member that is configured to selectively change shape by way of heat activation, wherein sealing member can move between a first position in which the opening is substantially blocked so as to prevent material flow therethrough, and a second position in which the opening is substantially unblocked so as to enable material flow therethrough.

DETAILED DESCRIPTION OF THE INVENTION

Various embodiments in accordance with the present invention include sealing apparatus and methods and more specifically, thermally activated sealing apparatus and methods. The sealing apparatus and methods disclosed herein can be beneficially applicable in the field of electrophotographic imaging, although it is understood that other fields of application are contemplated as well. The various embodiments of the invention described herein generally include a thermally activated sealing member that can be caused to selectively and alternately block and unblock an opening by way of thermal activation of the sealing member, wherein heat energy is applied thereto.

Figure 1:
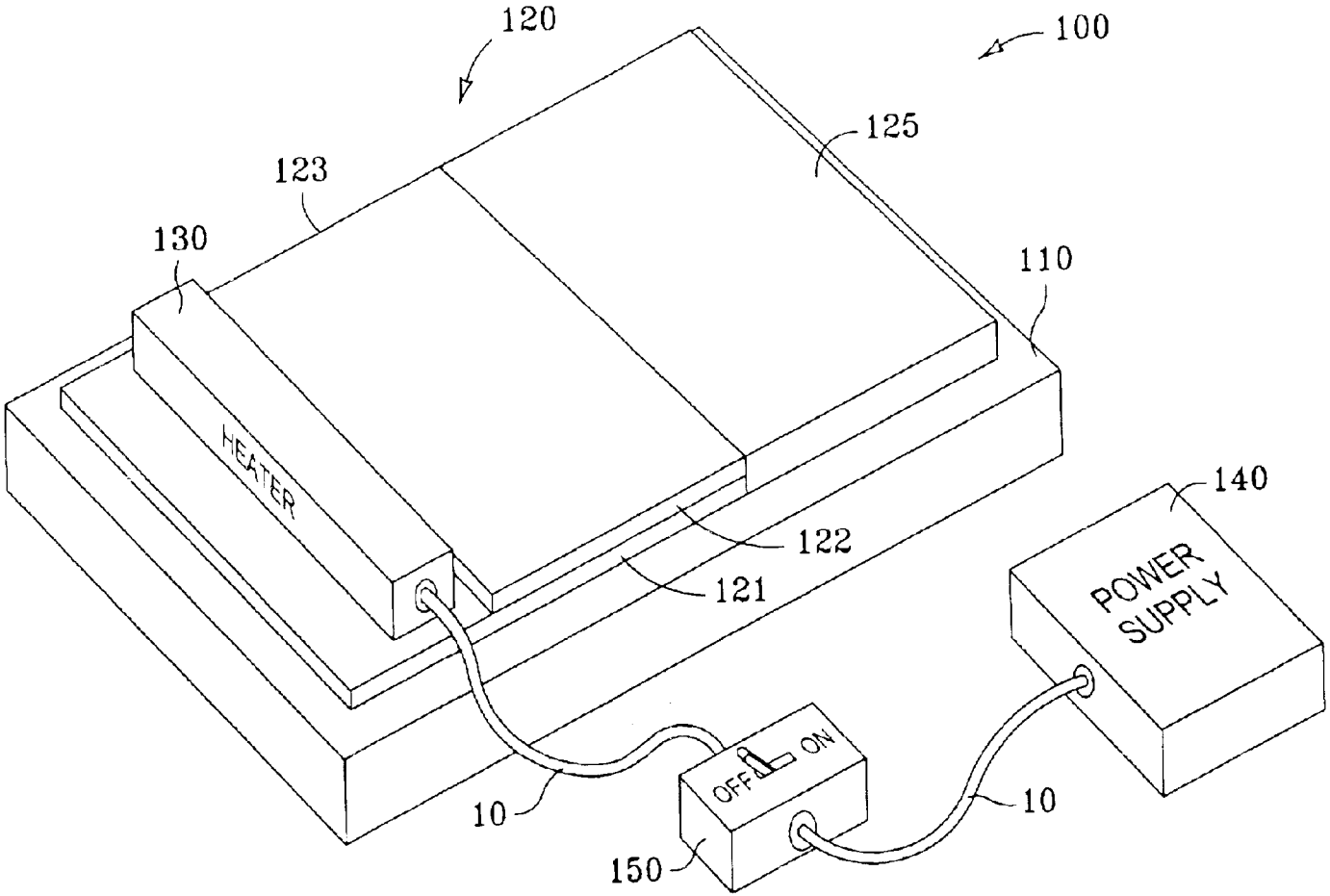
FIG. 1 is an isometric view in which a thermally activated sealing apparatus is depicted in accordance with one embodiment of the present invention, wherein the sealing member is shown in a closed position.

With reference to FIG. 1, an isometric view is shown in which a sealing apparatus 100 is depicted in accordance with one embodiment of the invention. The apparatus 100 includes a frame 110, and a thermally activated sealing member 120. The terms "thermally activated," and "thermally activatable," as used herein, mean capable of being activated, or operated, by way of heat energy absorption, as is explained in greater detail below. More specifically, a "thermally activated" device, as well as a "thermally activatable device," can be selectively operated, or activated, by way of selective supply, or exposure, of a given quantity of heat energy to the device.

As shown, the sealing member 120 can be operatively supported by the frame 110. However, it is understood that the sealing member 120 need not be supported by the frame 110. As is further seen, the frame 110 defines an opening therethrough. Thus, the sealing member 120 can be operatively supported by the frame 110, or alternatively, can be supported by an element other than the frame 110, whereby the orientation of the sealing member relative to the frame enables the sealing member to function to selectively block and unblock the opening 20 as is described below.

The sealing member 120 includes a flexible member 123. The flexible member 123 is configured to change shape when heated. More specifically, the flexible member 123 is configured to change shape when heated, wherein the change in shape of the flexible member results in the blocking, or unblocking, of the opening 20. The flexible member 123 is fabricated from a material, or materials, which change shape in response to a temperature change thereof. It is understood that the phrase "change shape" includes "change in dimension."

For example, the flexible member 123 can be fabricated from a shape memory alloy ("SMA"). Shape memory alloys are known. One of the most common shape memory alloys is known by the name, "nitinol." Shape memory alloys are known to change shape when heated. Furthermore, shape memory alloys are known to return to their original shape when cooled. That is, a given element that is fabricated from a shape memory alloy can have a first shape at, for example, ambient temperature. When the given element is heated to, for example, 150° F. above ambient temperature, the given element will have a second shape. If the given element is allowed to cool back to ambient temperature, the given element again attains the first shape.

As another example, the flexible member 123 can include both a hyper-expansive element 121, as well as a hypo-expansive element 122. The term "hyper-expansive element" as used herein is defined as any element with which a relatively high coefficient of thermal expansion is associated. Likewise, the term "hypo-expansive element" as used herein is defined as any element with which a relatively low coefficient of thermal expansion is associated.

That is, the coefficient of thermal expansion associated with the hyper-expansive element is high relative to that of the hypo-expansive element, while the coefficient of thermal expansion associated with the hypo-expansive element is low relative to that of the hyper-expansive element. It is understood that the term "coefficient of thermal expansion" refers to the rate of dimensional expansion experienced by a given object per unit temperature increase thereof.

Both the hyper-expansive element 121 and the hypo-expansive element 122 can be in substantially sheet form as shown. That is, the hyper-expansive element 121 and/or the hypo-expansive element 122 can be substantially thin and relatively flat. Furthermore, the hyper-expansive element 121 and the hypo-expansive element 122 can be in substantially sheet form and bonded to one another in a bi-layered manner. By way of example only, the hyper-expansive element 121 and the hypo-expansive element 122 can be in the form of a "bimetallic" element.

Thus, the hyper-expansive element 121 and the hypo-expansive element 122 can be connected, or affixed, to one another by bonding or other such means, so as to give the appearance of a single sheet of material that includes two layers, wherein the hyper-expansive element is one of the layers, and the hypo-expansive element is the other of the layers. The hyper-expansive element 121 and the hypo-expansive element 122 can be oriented in substantially parallel, juxtaposed registration relative to one another as shown.

As is further shown, the sealing member 120 can include an extension member 125. The extension member 125 can be connected to, or alternatively supported by, the flexible member 123. The extension member 125 can be employed to effectively enlarge the reach, or coverage, of the sealing member 120. That is, for a given size of the flexible member 123, the inclusion of an extension member 125 can enable the sealing member 120 to controllably cover a larger opening 20. The extension member 125 can be configured so as to be substantially unaffected by heat. That is, the extension member 125 can be fabricated from a material that does not substantially change shape as a function of the temperature thereof.

The apparatus 100 can also include a heat source 130. The heat source 130 is configured to produce heat energy that can be absorbed by the flexible member 123. The heat source 130 can be supported on the apparatus 100 as shown, although it is understood that the heat source need not contact any other element or component of the apparatus. That is, the heat source 130 can be supported in contact with the sealing member 120. Alternatively, the heat source 130 can be supported in contact with the flexible member 123. However, it is understood that the heat source 130 can also be supported in a manner wherein contact of the sealing member 120 therewith does not occur.

As further shown in FIG. 1, the apparatus 100 can include a power source 140 that is configured to supply power to the heat source 130. The apparatus 100 can also include a switch 150 that is configured to control the flow of power from the power source 140 to the heat source 130. For example, the power source 140 can be in the form of an electrical power supply configured to supply electrical power to the heat source 130, in which the heat source can be an electrically-powered heater or the like. Likewise, the switch 150 can be an electrical switch that is configured to control the flow of electrical current between the power source 140 and the heat source 130.

The apparatus 100 can also include at least one power conduit 10 such as an electrical power cable or the like that is configured to transmit power from the power source 140 to the heat source 130. The switch 150, as shown, can be connected between the power source 140 and the heat source 150 by way of the power conduits 10. Thus, by way of example only, when the switch 150 is included in the apparatus 100, the switch can be switched between an "off" position, in which no operational power flows from the power source 140 to the heat source 130, and an "on" position, in which operational power flows from the power source to the heat source. In this manner, the production of heat energy by the heat source 130 can be controlled by manipulation of the switch 140.

It is noted that, with reference to FIG. 1, the switch 150 is shown in the "off" setting, wherein no power flows from the power source 140 to the heat source 130. That is, the heat source 130 is depicted as not producing heat energy. Therefore, the heat source 130 is depicted as not providing heat energy to the sealing member 120. In other words, the flexible member 123 is depicted as being in a non-thermally activated state, wherein no significant amount of heat energy has been absorbed thereby. This point becomes more relevant in later discussion.

Figure 2:
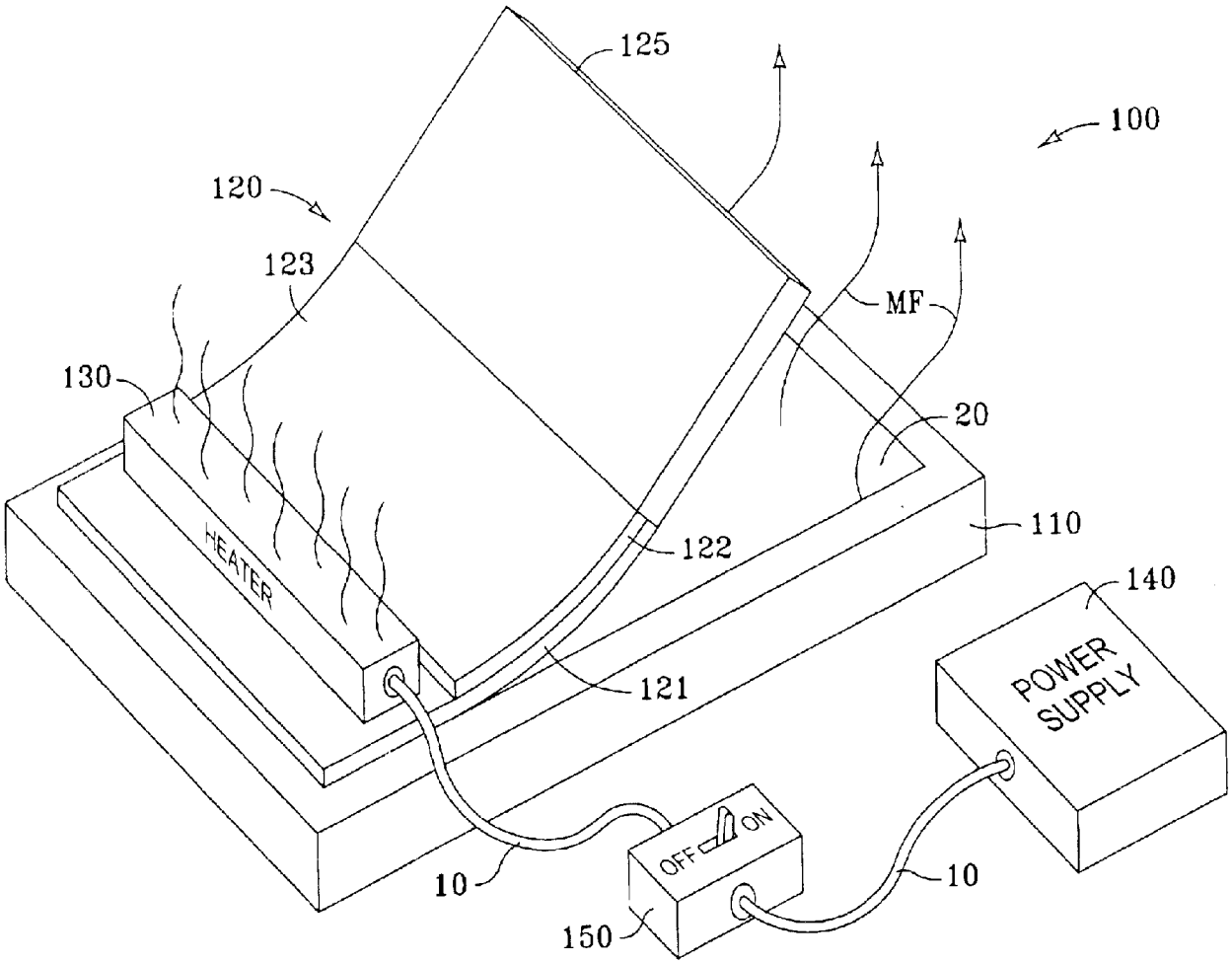
FIG. 2 is another isometric view of the thermally activated sealing member depicted in FIG. 1, wherein the sealing member is shown in an open position.

Turning now to FIG. 2, another isometric view is shown in which the apparatus 100 is depicted in an alternate operational mode. That is, with reference to FIG. 2, the switch 150 is shown in the "on" setting, wherein power flows from the power source 140 to the heat source 130. Therefore, the heat source 130 is depicted as producing heat energy, a significant quantity of which is shown to have been absorbed by the flexible member 123. Thus, the sealing member 120 is shown to be in an open position, thereby allowing material flow MF through the opening 20. In other words, still referring to FIG. 2, the heat source 130 is shown to be producing heat energy that is absorbed by the flexible member 123, thereby thermally activating the flexible member.

Thus, in contrast with the operational mode of the apparatus 100 that is shown in FIG. 1 and explained above with respect thereto, the operational mode of the apparatus as illustrated in FIG. 2 shows that the flexible member 123 can absorb a given quantity of heat energy, whereby the flexible member can become thermally activated. The heat energy that is produced by the heat source 130, and which is absorbed by the flexible member 123, can cause the flexible member to change shape.

For example, if the flexible member 123 includes the hypo-expansive element 121 and the hypo-expansive element 122, then the disparity between the dimensional expansion rates of the hyper-expansive element 121 and the hypo-expansive element 122, respectively, can cause the flexible member to change shape when heat energy is absorbed thereby, as can be seen with reference to both FIGS. 1 and 2. It is understood that a change in shape of the flexible member 123 in response to heat absorption thereby can also occur in an alternative case, wherein the flexible member is fabricated from a shape memory alloy, for example, as is mentioned above.

The shape change of the flexible member 123 as the result of thermal activation thereof, can cause the sealing member 120 to move from a closed position to an open position, or from an open position to a closed position, depending on the specific configuration and orientation of the sealing member. That is, it is understood that the sealing member 120 can be configured in an alternative configuration (not illustrated herein) in accordance with which the thermal activation of the sealing member results in the blocking of the opening 20 by the sealing member, and wherein the opening is not blocked by the sealing member when the sealing member is not thermally activated.

Thus, the specific function of the sealing member 120 in response to thermal activation thereof can be determined by the specific shape of the sealing member when not thermally activated, as well as by the orientation of the sealing member with respect to the opening 20. As is illustrated in FIGS. 1 and 2 by way of example only, the sealing member 120 is configured and oriented in a manner whereby thermal activation thereof can cause the sealing member to unblock the opening 20.

As mentioned above, such unblocking of the opening 20 by the thermal activation of the sealing member 120 can allow material flow MF through the opening. As can be appreciated, the sealing member 120 can be employed to selectively control material flow MF through the opening 20, wherein, by way of example only, non-thermal activation of the sealing member can cause the opening to be blocked, and wherein thermal activation of the sealing member can cause the opening to be unblocked.

In other words, the sealing member 120, as is specifically depicted in FIGS. 1 and 2 by way of example only, is configured to substantially block the opening 20 at relatively low temperatures of the sealing member, and is further configured to unblock the opening at relatively high temperatures of the sealing member. Alternatively, the relative position and/or shape of the flexible member 123 can be reversed so that the flexible member is bent, or curved, at relatively low temperatures, and is substantially straight, or flat at relatively high temperatures.

As is discussed above, the change in shape of the flexible member 123, which can be caused by thermal activation thereof, can be employed to selectively block and unblock an opening such as the opening 20. That is, as shown, the switch 150 can be selectively switched between an "on" position and an "off" position, wherein power is supplied and not supplied, respectively, to the heat source 140.

Thus, when power is not supplied to the heat source 130, the flexible member 123 is not thermally activated. When the flexible member 123 is not thermally activated, the sealing member 120 can, as is depicted by way of example only in FIG. 1, act to seal, or at least substantially block, the opening 20, thus preventing material flow MF therethrough.

However, as is mentioned above, in an alternative configuration and/or orientation which is not depicted but which is explained above, the sealing member 120, when the flexible member 123 is not thermally activated, can be in an open position whereby the opening 20 is not blocked.

When power is supplied to the heat source 130, the heat source can produce heat energy that can be absorbed by the sealing member 120, and more specifically, by the flexible member 123. The flexible member 123, upon absorbing a given quantity of heat energy, can become thermally activated, resulting in a change of shape thereof. The thermal activation of the flexible member 123 can result in the opening 20 becoming unblocked as is depicted in FIG. 2. An alternative configuration and/or orientation of the sealing member 120 can result in the opening 20 becoming blocked when the flexible member 123 becomes thermally activated, as explained above.

Furthermore, it is understood that the switch 150 which controls the flow of power to the heat source 130 can be replaced with a coupling such as is described below in greater detail and which is shown in another figure as noted below. That is, rather than employing a switch, such as the switch 150 to control the flow of power to the heat source 130, a coupling (not shown) can be employed, wherein the power to the heat source can be selectively connected and/or disconnected in order to control the flow of power to the heat source.

As is explained above with reference to FIGS. 1 and 2, it is also understood that in accordance with one possible configuration of the sealing member 120, the extension 125 can be omitted, wherein the flexible member 123 is configured to selectively cover, or block, substantially the entire opening 20. In accordance with an alternative configuration of the sealing member 120, the sealing member can include both a flexible member 123 and an extension member 125 that is operatively connected to the flexible member, wherein the flexible member and the extension member together act to cover, or block, substantially the entire opening 20 as is specifically depicted by way of example only in FIGS. 1 and 2.

In any case, the sealing member 120 can be configured to selectively move, by way of thermal activation, between a closed position and an open position, wherein when in the closed position, the sealing member substantially covers, or blocks, the opening 20 so as to substantially prevent material flow MF through the opening 20, and wherein when in the open position, the sealing member uncovers, or unblocks, at least a portion of the opening so as to allow material flow MF therethrough.

It is noted that, as illustrated in FIGS. 1 and 2, the sealing member 120 has a blade form. That is, the term "blade form" means a substantially flat, planar form that is affixed to a supportive member substantially at only one edge, whereby the sealing member can bend so as to substantially unblock the opening 20. As explained further below, a sealing member in accordance with at least one alternative embodiment of the invention can have an alternative form and/or configuration.

Figure 3:
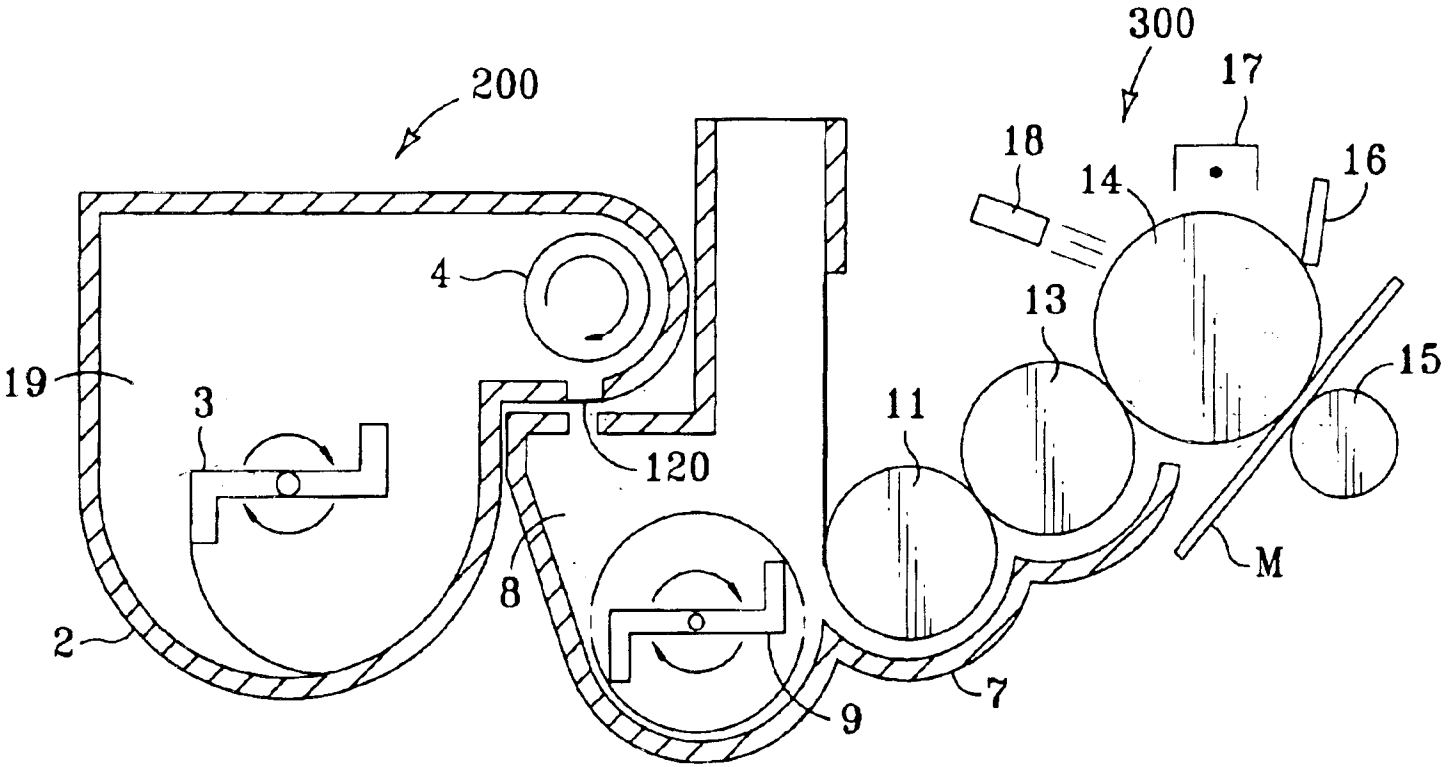
FIG. 3 is a side elevation schematic view in which an imaging device and a toner cartridge are depicted in accordance with another embodiment of the present invention.

Turning now to FIG. 3, a side elevation schematic view is shown in which a toner cartridge 200 and an electrophotographic imaging device 300 are depicted in accordance with another embodiment of the invention. That is, FIG. 3 presents one example of a specific application in which the thermally activated sealing member 120 can be employed. For example, the thermally activated sealing member 120, which is discussed above, can be included in a toner cartridge 200 that is configured to contain a quantity of toner (not shown).

The toner cartridge 200 can be configured to dispense the toner onto an optical photoconductor 14 that can be operatively supported within the electrophotographic imaging device 300, or "laser printer." Electrophotographic imaging devices, and their operation, are well known in the art and need not be discussed in detail herein. In general, the electrophotographic imaging device 300 together with the toner cartridge 200, can function to produce an image from the toner and to affix the image onto the media, or image carrier, M.

The electrophotographic imaging device 300 can include a number of components that are typically included in conventional electrophotographic imaging devices. For example, in addition to the optical photoconductor 14, the imaging device 300 can include a laser 18, or other suitable light source, as well as a charging device 17, and a cleaning device 16. The imaging device 300 can also include such components as a transfer roller 15, as well as various other rollers 11 and 13 that can be employed to move the toner to the optical photoconductor 14.

By way of example only, the rollers 11 and 13 can be developing rollers that can be employed to "develop" the image on the optical photoconductor 14. The imaging device 300 can also include a paddle device 9 that is configured to facilitate movement of the toner onto the rollers 11 and 13. The imaging device 300 also can include a housing 7. The housing 7 can define a cavity 8 in which the other components are operatively supported, as shown.

Likewise, the toner cartridge 200 can include a body 2 that defines a toner reservoir 19 in which the toner can be stored. The toner cartridge 200 can also include various other components configured to facilitate movement and control of the toner. For example, a stirring device 3 can be included in the toner cartridge 200, wherein the stirring device is operatively supported within the reservoir 19. Additionally, a roller 4 can also be included in the toner cartridge 200, wherein the roller is also operatively supported within the reservoir 19.

As is depicted, the toner cartridge 200 can be configured to be removably supported by the imaging apparatus 300, wherein, when the toner cartridge is supported on the imaging apparatus, toner can be drawn from the toner cartridge and transferred into the cavity 8 in facilitation of the production of images in the manner briefly discussed above.

That is, the toner cartridge 200 can be configured to be removable from, and replaceable onto, the imaging apparatus 300. In this manner, once the toner is depleted from the toner cartridge 200, it can be removed from the imaging device 300, and a like toner cartridge that contains a supply of toner can be replaced onto the imaging device. Such a removable and/or replaceable nature of toner cartridges is generally known and practiced in the art.

Figure 4:
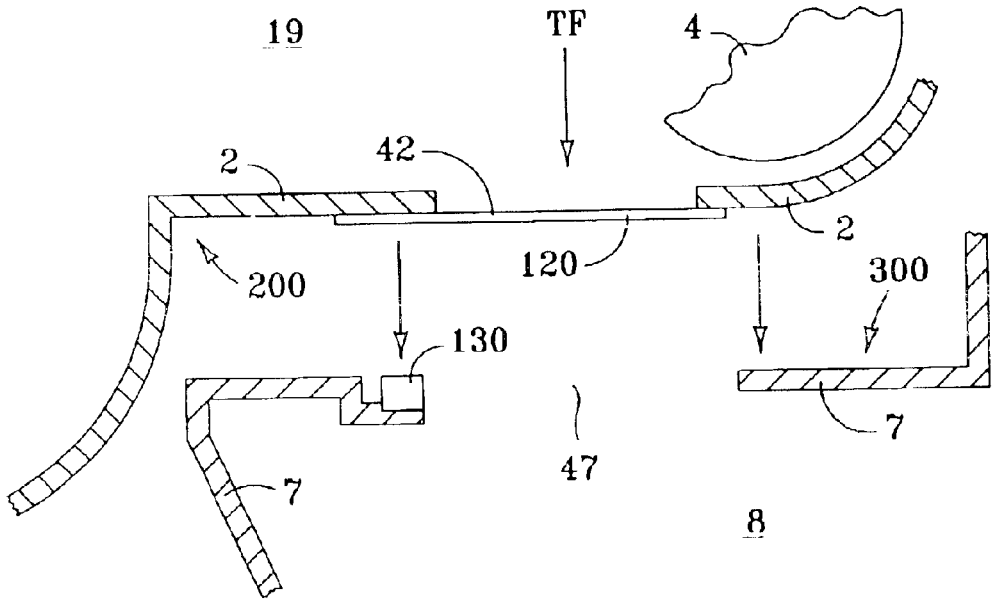
FIG. 4 is a side elevation schematic detail view of the imaging device and toner cartridge depicted in FIG. 3.

Moving now to FIG. 4, a side elevation schematic detail view is shown in which particular portions of the toner cartridge 200 and the imaging device 300 are depicted with greater clarity. That is, FIG. 4 is intended to be a "close-up" view of the sealing member 120 and associated elements of the toner cartridge 200 and imaging apparatus 300 that are depicted in FIG. 3. As is seen in FIG. 4, the toner cartridge 200 can include the thermally activated sealing member 120 that is described above in detail with respect to the apparatus 100.

It is noted that, as depicted in FIG. 4, the toner cartridge 200 is not supported by the imaging device 300. That is, the toner cartridge 200 is shown to be separated from the imaging device 300. However, as is indicated by the directional arrows in FIG. 4, the toner cartridge 200 can be moved toward the imaging apparatus 300 so as to be supported thereby as explained further below. It is further noted that the sealing member 120, as shown in FIG. 2, can have a blade form as described above with respect to the apparatus 100.

As is seen, the body 2 defines an opening 42 therethrough. The sealing member 120 can be supported on the body 2 proximate the opening 42 in the manner depicted, wherein the sealing member can substantially block the opening when not thermally activated. That is, the sealing member 120 can be configured to control toner flow TF through the opening 42. More specifically, as depicted in FIG. 4, the sealing member 120 is not thermally activated, and is blocking the toner flow TF through the opening 42. In other words, as shown in FIG. 4, the sealing member 120 is in a closed position.

As is also seen, the housing 7 of the imaging device 300 defines a toner port 47 therethrough. The opening 42 and the port 47 can be located relative to the body 2 and housing 7, respectively, such that when the toner cartridge 200 is operatively supported by the imaging device 300, the opening and the port are substantially aligned in juxtaposed registration with one another for passage of toner therethrough from the toner cartridge to the imaging device. In this manner, the flow of toner from the toner reservoir 19 into the cavity 8 is facilitated.

As is further seen in FIG. 4, the imaging device 300 can include a heat source 130. The heat source 130 is described in greater detail above with respect to the apparatus 100. It is understood that the heat source 130 can have any of a number of possible shapes and/or configurations and/or orientations not specifically illustrated herein. It is further understood that the heat source 130 need not be specifically configured to produce heat energy. That is, the heat source 130 can be a device that produces heat energy as a by-product, or as a secondary function.

The heat source 130 can supported by the housing 7 proximate the port 47, as shown. More specifically, the heat source 130 can be located in a position relative to the port 47 such that, when the toner cartridge 200 is operatively supported by the imaging device 300, the heat source operatively contacts the sealing member 120 in facilitation of the transfer of heat energy thereto. However, as is discussed below, the heat source 130 need not come into direct contact with the sealing member 120.

Figure 5:
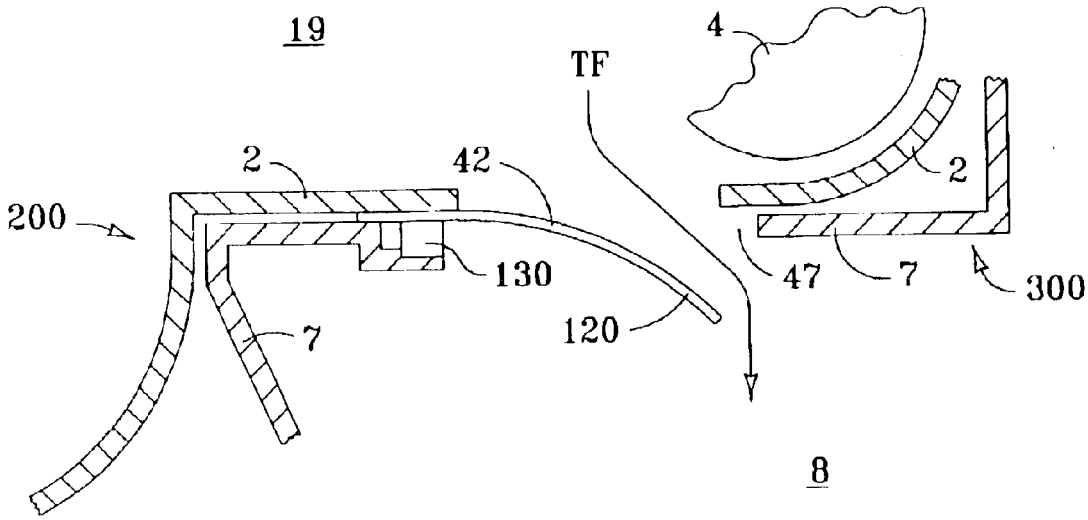
FIG. 5 is another side elevation schematic detail view of the imaging device and toner cartridge depicted in FIG. 3.

The operation of the sealing member 120 is readily seen with reference to FIG. 5 which is another side elevation schematic detail view, or "close-up" in which the toner cartridge 200 and the imaging device 300 are depicted. As is further seen, the toner cartridge 200 is depicted as being operatively supported on the imaging device 300. When the toner cartridge 200 is thus supported by the imaging device 300, the heat source 130 can come into contact, or at least into operative proximity, with the sealing member 120.

The heat source 130 can come into direct contact with the sealing member 120 as a result of placement of the toner cartridge 200 into an operatively supported position on the imaging device 300, as shown. However, it is understood that the heat source 130 need not come into direct contact with the sealing member 120 when the toner cartridge 200 is operatively supported by the imaging device 300.

Instead, when the toner cartridge 200 is operatively supported by the imaging device 300, the heat source 130 can at least come into sufficient proximity with the sealing member 120, whereby an operative quantity of heat energy is transferable from the heat source to the sealing member. In other words, the heat source 130 need only be close enough to the sealing member 120 to transfer a given quantity of heat thereto, wherein the given quantity of heat is sufficient to enable thermal activation, and thus operation, of the sealing member.

In any case, heat energy supplied by the heat source 130 can be absorbed by the sealing member 120, whereby the sealing member is thermally activated. Such thermal activation of the sealing member 120 can result in a shape change thereof as is explained above. The change in shape of the sealing member 120 as the result of the thermal activation thereof can cause the sealing member to unblock the opening 42. When the sealing member 120 unblocks the opening 42, the toner flow TF is free to proceed from the reservoir 19, and through the opening, and then through the port 47, and into the cavity 8, as depicted. Thus, as depicted in FIG. 5, the sealing member 120 is shown in an open position as the result of thermal activation thereof.

As can be appreciated from a study of FIGS. 4 and 5, the sealing member 120 can be employed in conjunction with the toner cartridge 200 and the imaging device 300 to control the flow of toner from the toner reservoir 19. More specifically, by way of example only, the sealing member 120 can thus be employed in the manner of an automatic toner dam which remains closed to block flow of toner from the reservoir 19 when the toner cartridge 200 is not installed in the imaging device 300, and when the sealing member is not thermally activated. However, the sealing member 120 can be caused to open automatically to allow toner flow TF from the reservoir 19 and into the cavity 8 when the toner cartridge 200 is installed on the imaging device 300 and when the sealing member becomes thermally activated.

Moreover, it is seen that the sealing member 120 can be configured to automatically close when the toner cartridge 200 is removed from the imaging device 300, or when the toner cartridge remains supported on the imaging device when the supply of electrical power thereto is terminated. That is, for example, when the imaging device 300 is unplugged from an electrical power source, such as from a wall socket (not shown), the heat source 130 will cease the production of heat energy, and the sealing member 120 will therefore cease to be thermally activated, resulting in a change of shape so as to move to the closed position, thus blocking the flow of toner from the reservoir 19 and through the opening 42.

Alternatively, when the toner cartridge 200 is removed from the imaging device 300, the sealing member 120 is removed from proximity or contact with the heat source 130, wherein the sealing member ceases to be thermally activated. This, in turn, results in the movement of the sealing member 120 from an open position to a closed position, thus blocking the toner flow TF through the opening 42. In this manner, toner leakage can be substantially prevented when the toner cartridge 200 is removed from the imaging device 300 and during movement and/or transport of the imaging device with toner cartridge installed thereon.

Figure 6:
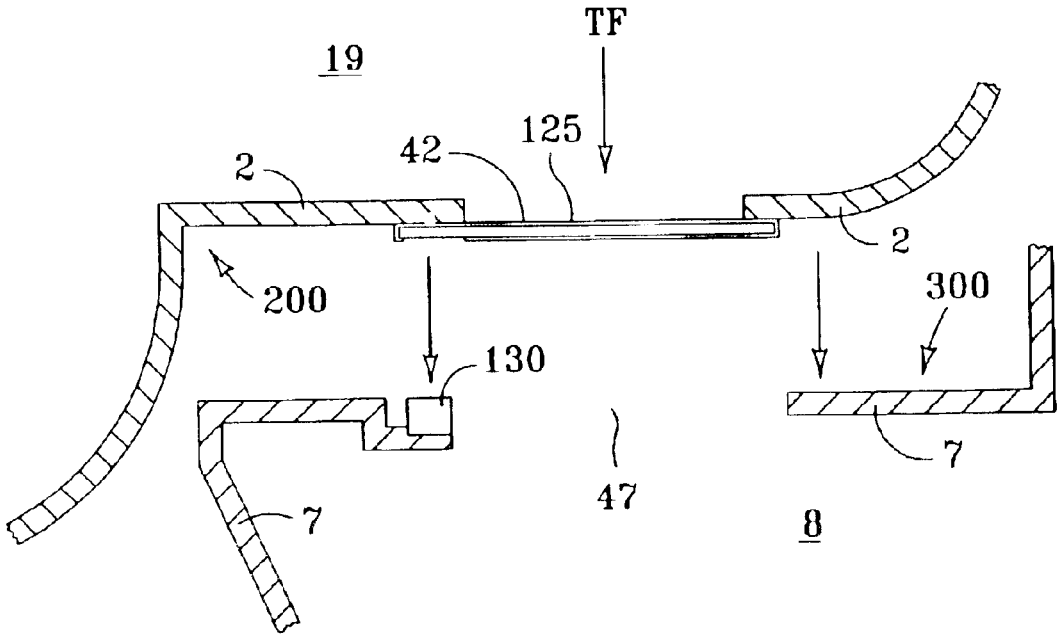
FIG. 6 is another side elevation schematic detail view of the imaging device and toner cartridge depicted in FIG. 3, wherein an alternative configuration of the sealing member is shown.

Turning now to FIG. 6, a side elevation schematic detail view is shown in which the imaging device 300, along with an alternative configuration of the toner cartridge 200 are depicted. That is, the toner cartridge 200 and the imaging device 300 that are depicted in FIG. 6 can be substantially identical to the toner cartridge and imaging device that are depicted in FIGS. 4 and 5, with the exception of a coating 125 that can be applied to the sealing member 120.

More specifically, the coating 125 can substantially surround the sealing member 120 as shown. The coating 125 can be an elastomeric coating that is substantially flexible and relatively durable. The coating 125 can serve as a thermal insulator with respect to the sealing member 120. As a thermal insulator, the coating 125 can retard the loss of heat energy from the sealing member, for example, and can also prevent the transfer of heat energy to the toner and/or to objects such as the body 2 of the toner cartridge 200.

Figure 7:
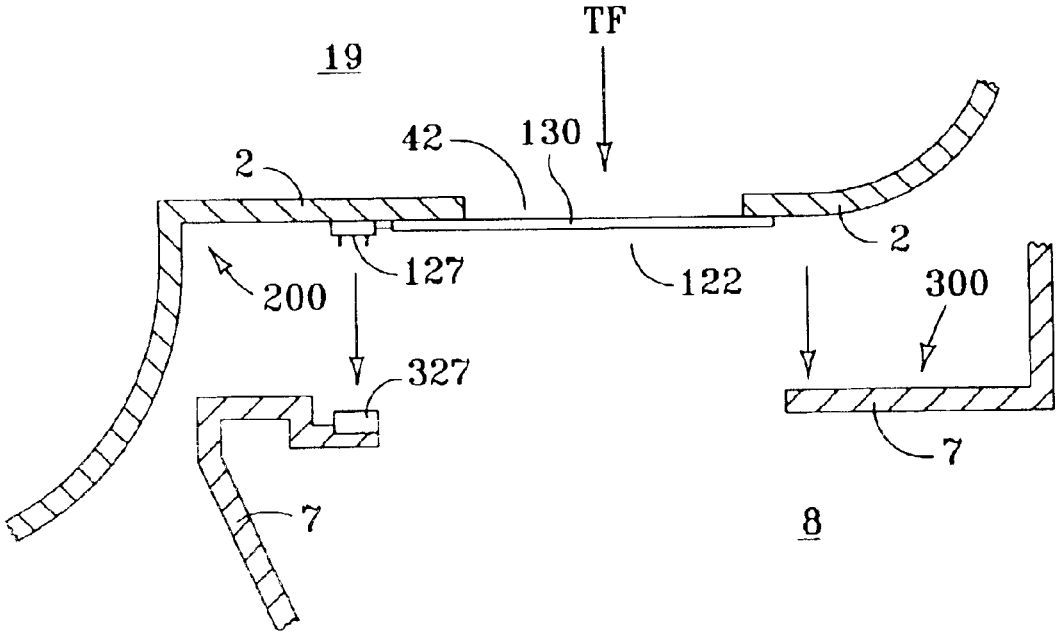
FIG. 7 is another side elevation schematic detail view of the imaging device and toner cartridge depicted in FIG. 3, wherein another alternative configuration of the sealing member is shown.

Moving now to FIG. 7, another side elevation schematic detail view is shown in which a further alternative configuration of the toner cartridge 200, as well as an alternative configuration of the imaging device 300 are shown. For example, in the alternative configuration thus shown, the heat source 130 can be operatively supported by the toner cartridge 200. Furthermore, the heat source 130 can have a substantially sheet, or strip, form as is depicted. In such a case, the heat source 130 in sheet or strip form can be bonded to at least a portion of the sealing member 120.

Moreover, in such a case wherein the heat source 130 has a sheet or strip form, the heat source can be oriented in parallel, juxtaposed aligned registration with the sealing member 120 in facilitation of heat transfer thereto from the heat source. As is further seen, when the heat source 130 is operatively supported by the toner cartridge 200, the toner cartridge can include an electrical contact 127 that is operatively supported by the toner cartridge. The electrical contact 127 can be electrically linked with the heat source 130, whereby operational electrical power can be supplied to the heat source by way of the electrical contact.

Similarly, the imaging device 300 can include an electrical receptacle 327 operatively supported by the imaging device. As is seen, the electrical receptacle 327 can be configured to electrically link with the electrical contact 127 when the toner cartridge 200 is placed into an operatively supported position on the imaging device 300, whereby electrical energy can be supplied to the heat source 130 from the imaging device by way of the electrical receptacle and the electrical contact. In this manner, the sealing member 120 can open only when provided with electrical power from the imaging device 300, which can occur only when the toner cartridge 200 is placed in an operatively supported position on the imaging device which, in turn, can result in the electrical connection of the electrical receptacle 327 to the electrical contact 127.

Thus, the electrical receptacle 327 and the electrical contact 127 can be positioned relative to the imaging device 300 and to the toner cartridge 200, respectively, so as to be in substantially connectively aligned registration with one another when the toner cartridge is placed in an operatively supported position on the imaging device. That is, the electrical contact 127 and the electrical receptacle 327 can be positioned so that when the toner cartridge 200 is installed on the imaging device 300, then the electrical contact and the electrical receptacle can automatically link for electrical power transmission therebetween.

Although not specifically depicted in the interest of clarity, the sealing member 120 that is shown in FIG. 7 can also include the coating 125 shown in FIG. 6 and described above. The coating 125 can be applied so as to substantially surround both the heat source 130 and the sealing member 120 in the form depicted in FIG. 7. This can prevent direct contact of the heat source 130 with the toner contained in the toner reservoir 19 of the toner cartridge 200.

Figure 8:
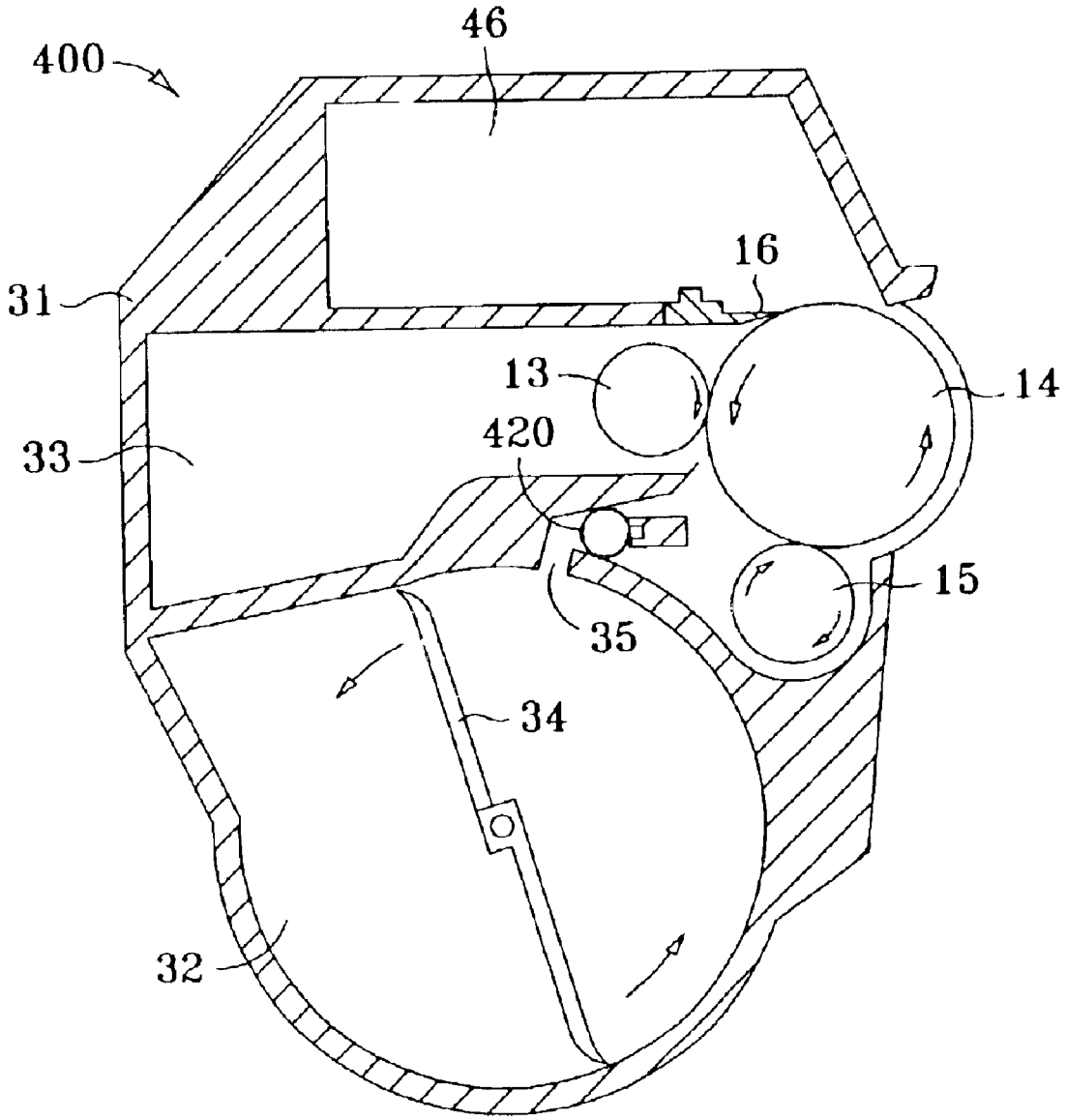
FIG. 8 is a side elevation sectional view in which a toner cartridge is depicted in accordance with another embodiment of the present invention.

Turning to FIG. 8, a side elevation sectional view is shown in which a toner cartridge 400 is depicted in accordance with another embodiment of the invention. The toner cartridge 400 includes a body 31 that defines a toner reservoir 32. The toner reservoir 32 is configured to contain a quantity of toner (not shown). A stirring device 34 can also be included in the toner cartridge 400, wherein the stirring device is operatively disposed within the reservoir 32. The body 31 can also define an antechamber 33. A waste hopper 46 can also be defined by the body 31 as is shown.

The toner cartridge 400 can be configured to operatively support the optical photoconductor 14 as well as one or more of the rollers 13 and 15, which are each described above with respect to the apparatus 100 and 300. The optical photoconductor 14 can be located within the antechamber 33, as can the rollers 13 and 15. The toner cartridge 400 can also include the cleaning device 16 which can be employed to remove waster toner and other debris from the optical photoconductor 14. Such waste toner and debris removed from the optical photoconductor 14 can be collected in the waste hopper 46.

The toner cartridge 400 can also include a sealing member 420 that is explained in greater detail below. The sealing member 420 can be operatively supported by the toner cartridge 200, and more specifically, can be operatively supported by the body 31. As is further seen from a study of FIG. 8, the body 31 defines an opening 35 through which toner can be moved from the reservoir 32 to the optical photoconductor 14. In other words, toner can pass through the opening 35 on its way from the reservoir 32 to the antechamber 33. As is further seen, the sealing member 420 can be operatively disposed at, or proximate to, the opening 35 to thereby facilitate toner flow control through the opening in the general manner of the sealing member 120 as is explained above with respect to the toner cartridge 200.

Still referring to FIG. 8, the toner cartridge 400 is configured to be operatively supported on an imaging device (not shown) wherein the reservoir 32 can contain a toner (not shown) that can be processed by the imaging device so as to produce an image from the toner, wherein the image can be affixed to a sheet of media (not shown) or the like. It is understood that the specific configuration of the toner cartridge 400, as well as that of the toner cartridge 200 discussed above, are set forth herein as illustrative examples only.

That is, a toner cartridge in accordance with various embodiments of the present invention is not intended to be limited to specific configurations as depicted in the accompanying figures and as described herein. More specifically, it is understood that a toner cartridge in accordance with any of the embodiments of the invention which are either contemplated or specifically illustrated herein need not include all of the components specifically mentioned, and need not have the exact, or similar, configurations of the components and/or elements as specifically mentioned.

Figure 9:
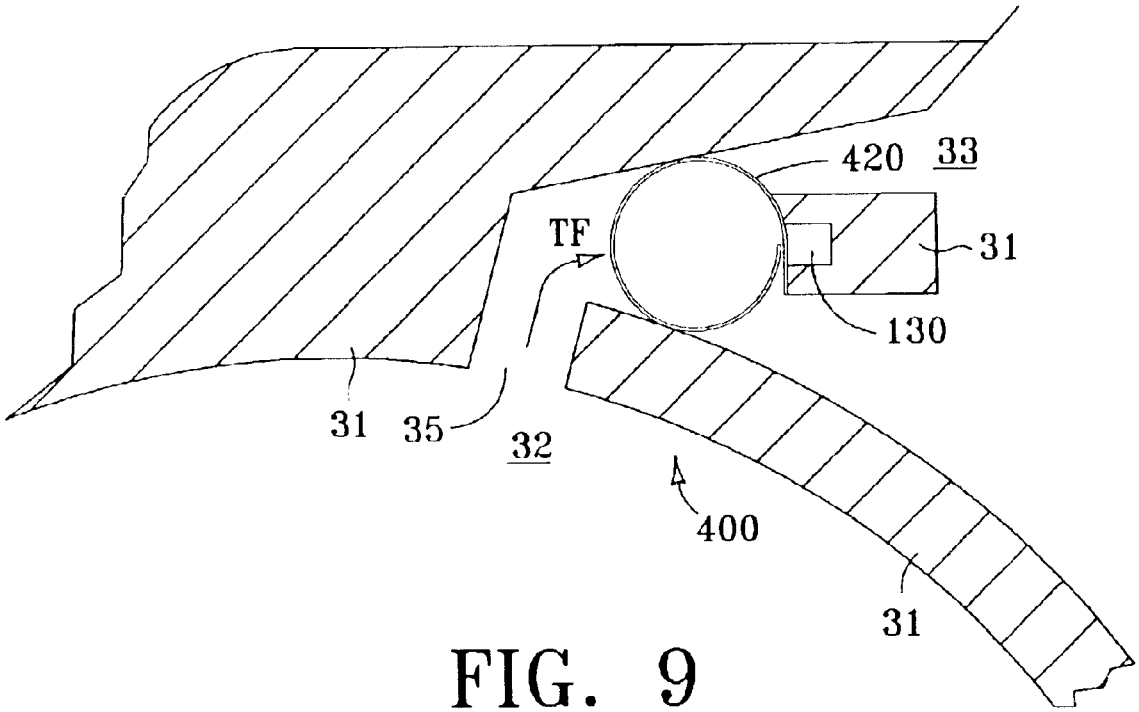
FIG. 9 is a side elevation sectional detail view of the toner cartridge depicted in FIG. 8, wherein the sealing member is shown in a closed position.

Moving now to FIG. 9, a side elevation schematic detail view is shown in which the sealing member 420 is depicted along with a portion of the body 31 of the toner cartridge 400. That is, FIG. 9 is intended to be a "close-up" of the opening 35 and the sealing member 420, as well as related elements, which are depicted in FIG. 8. As is seen, the sealing member 420 can be operatively disposed at, or proximate to, the opening 35 through which toner can move from the toner reservoir 32 to the optical photoconductor 14 (shown in FIG. 8).

The sealing member 420 can also be operatively supported by the body 31 as is shown. As is further shown in FIG. 9, the sealing member 420 can be in the shape of a cylindrical, overlapping roll. That is, in its non-thermally activated state, the sealing member 420 can be formed into a substantially cylindrical roll that overlaps itself slightly as shown.

As is seen, one distinction that can be made between the sealing member 420 and the sealing member 120 (shown in FIGS. 1 and 2) is that the former is rolled into a substantially cylindrical overlapping form, while the latter has a substantially planar blade form. However, it is understood that the specific shapes of the sealing members 120 and 420 as depicted and described herein are intended to provide illustrative examples only, and are not intended to limit the shape of a sealing member.

As is further seen, the sealing member 420 can be sized so as to be capable of substantially blocking toner flow TF out of the reservoir 32 by way of the opening 35. That is, depending on the specific configuration of the sealing member 420, the sealing member 420 can be in contact with the body 31 when activated, or when non-activated, depending upon the specific configuration of the sealing member, so as to substantially block toner flow TF from the reservoir 32 to the antechamber 33.

The toner cartridge 400 can also include a heat source 130. The heat source 130 is described above with respect to the toner cartridge 200 and the imaging device 300. Still referring to FIG. 9, the heat source 130 can be operatively supported by the body 31, and can also be supported so as to be in contact with, or at least in operative proximity to, the sealing member 420.

Figure 10:
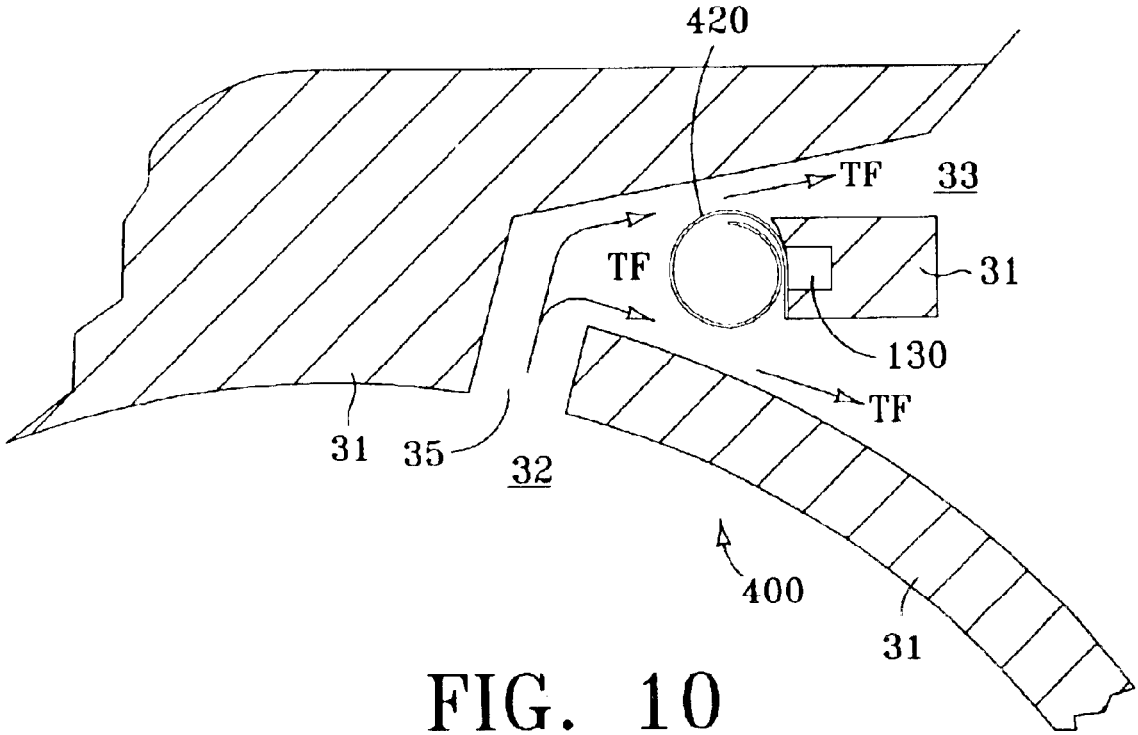
FIG. 10 is another side elevation detail view of the toner cartridge depicted in FIG. 8, wherein the sealing member is shown in an open position.

With reference now to FIG. 10, another side elevation schematic detail view, or close-up, is shown in which the sealing member 420 along with a portion of the body 31 is depicted. As is seen, the view shown in FIG. 10 is substantially identical to that shown in FIG. 9. However, as depicted in FIG. 10, sealing member 420 is depicted in the open position. For example, the heat source 130 can produce a given amount of heat energy which can be absorbed by the sealing member 420, which can thus cause thermal activation thereof, resulting in the movement of the sealing member from a closed position to an open position.

More specifically, heat energy produced by the heat source 130 can be absorbed by the sealing member 420, which can cause the sealing member to change shape. By way of example, only, such a change in shape of the sealing member 420 can be the curling thereof into a tighter roll. That is, as depicted in FIG. 9, the sealing member 420 cap have a substantially cylindrical form having an initial diameter. However, as depicted in FIG. 10, the sealing member 420 can change shape, thus attaining a diameter that is less than the initial diameter.

As is seen, this change of shape of the sealing member 420, which can be caused by the absorption of heat energy thereby from the heat source 130, can allow toner flow TF to occur between the reservoir 32 and the antechamber 33. That is, the thermal activation of the sealing member 420 can cause the sealing member to change shape, thus unblocking the opening 35 and allowing toner flow TF therethrough. In this manner, the sealing member 420 can be employed to control the toner flow TF out of the reservoir 32.

As can be appreciated, the amount of heat energy produced by the heat source 130 can be controlled in the manner discussed above with respect to the apparatus 100, wherein a switch (not shown) or the like can be employed to control the amount of electrical energy (or other form of energy) that is provided to the heat source. The power to the heat source 130 can alternatively be controlled in the manner described above with respect to apparatus 200 and 300 and shown in FIG. 7.

The control of the amount of heat produced by the heat source 130 in turn can enable control of the activation of the sealing member 420. That is, when heat energy is produced by the heat source 130 the sealing member 420 can become thermally activated by absorption of the heat energy, thus allowing toner flow TF. On the other hand, when the heat source 130 does not produce a significant quantity of heat energy, the sealing member 420 can cease to become thermally activated, or can become thermally de-activated, thus blocking the toner flow TF.

Figure 11:
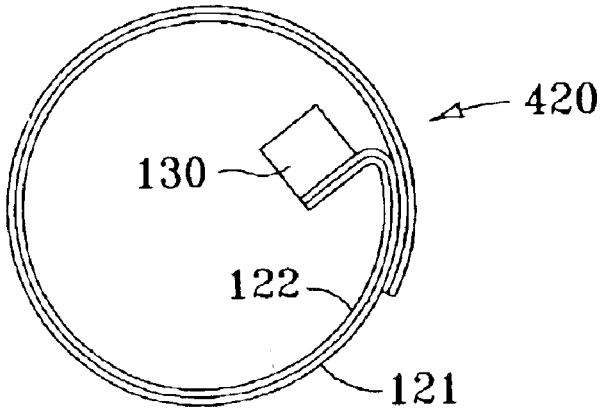
FIG. 11 is a side elevation detail view showing an alternative configuration of the sealing member of the toner cartridge depicted in FIG. 8.

Turning now to FIG. 11, a side elevation detail view is shown in which an alternative location of the heat source 130 is depicted. That is, more specifically, the heat source 130 can be located so as to be substantially surrounded by the sealing member 420. As is seen, the heat source 130 can be both surrounded by the sealing member 420 and in contact therewith. However, it is understood that, as explained above, the heat source 130 need not be in direct contact with the sealing member 420. The heat source 130 can, however, be close enough to the sealing member 420 so that heat energy can be transferred thereto from the heat source for thermal activation of the sealing member.

Also, as is depicted in FIG. 11, the sealing member 420 can include the hyper-expansive element 121 and the hypo-expansive element 122 which are explained above with respect to the sealing member 120. That is, the sealing member 420 can include the hyper-expansive element 121 and the hypo-expansive element 122 that are in a roll form as shown. However, it is understood that the sealing member 420 need not include the hyper-expansive element 121, or the hypo-expansive element 122. Rather, at a minimum, the sealing member 420 is required only to be configured to change shape in response to the absorption of heat energy.

Alternatively, the sealing member 420 can include a flexible member (not shown) that does not include either the hyper-expansive element 121 or the hypo-expansive element 122. That is, the sealing member 420 can include a flexible member, such as the flexible member 123 described above with respect to FIGS. 1 and 2, which can be fabricated from a material that changes shape in response to a change in temperature. For example, rather than including the hyper-expansive element 121 and the hypo-expansive element 122, the sealing member 420 can include a flexible member (not shown) that is fabricated from a shape memory alloy, for example.

Figure 12:
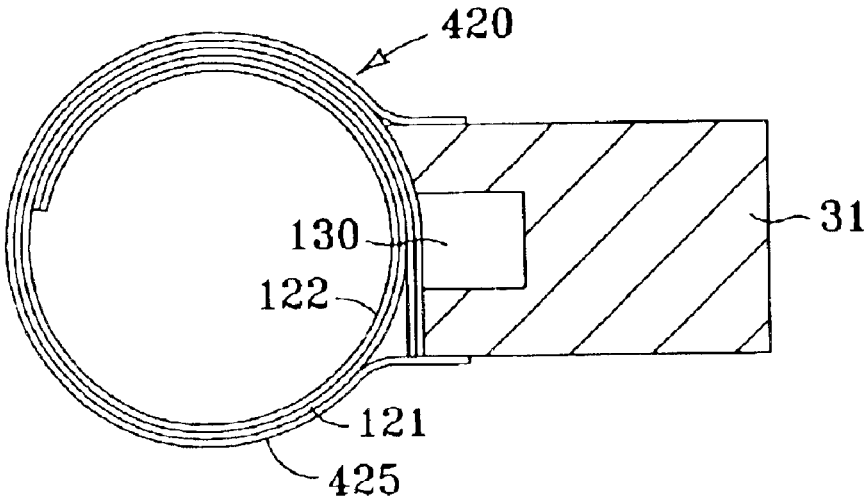
FIG. 12 is a side elevation detail view showing another alternative configuration of the sealing member of the toner cartridge depicted in FIG. 8.

Moving to FIG. 12, another side elevation detail view is shown in which a further alternative configuration of the sealing member 420 is depicted. As is shown, the toner cartridge 400 can include a sheath 425 that substantially surrounds the sealing member 420. The sheath 425 can be fabricated from an elastomeric material that is both resiliently flexible and durable. The sheath 425 can serve to thermally insulate the sealing member 420 so as to prevent heat loss therefrom to the surrounding environment. The sheath 425 can also serve to prevent debris and material such as toner and the like from coming into contact with the sealing member 420.

Figure 13:
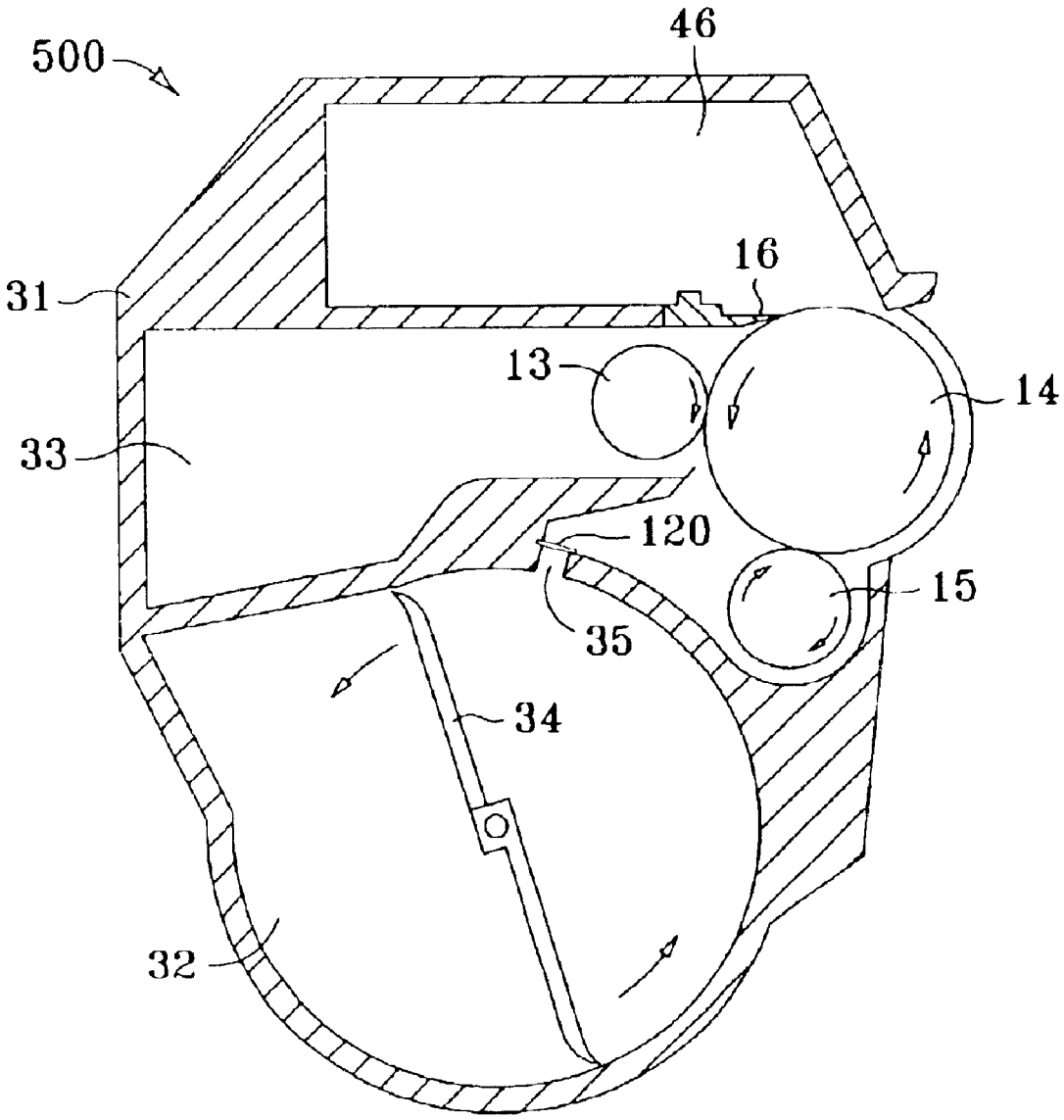
FIG. 13 is a side elevation sectional view in which a toner cartridge is depicted in accordance with still another embodiment of the present invention.

With reference now to FIG. 13, a side elevation sectional view is shown in which a toner cartridge 500 is depicted in accordance with yet another embodiment of the invention. It is seen that the toner cartridge 500 can be substantially similar to the toner cartridge 400 which is described above with reference to FIGS. 8, 9, and 10. However, the toner cartridge 500 depicted in FIG. 13 differs from the toner cartridge 400 in that the sealing member 120 is depicted as having a blade form, whereas the sealing member 420 of the toner cartridge 400 is depicted as having a substantially roll form. The sealing member 120 is explained in detail above with respect to FIGS. 1 and 2.

Thus, as is seen by a study of FIG. 13, the sealing member 120 can have a substantially blade form, and can be employed to control toner flow from one internal chamber of a toner cartridge 500 to another internal chamber thereof. For example, turning now to FIG. 14, a side elevation schematic detail view is shown in which the sealing member 120 is depicted along with a portion of the body 31 of the toner cartridge 500. That is, FIG. 14 is a "close-up" of the opening 35 and the sealing member 120, as well as related elements, of the toner cartridge 500 which is depicted in FIG. 13.

Figure 14:
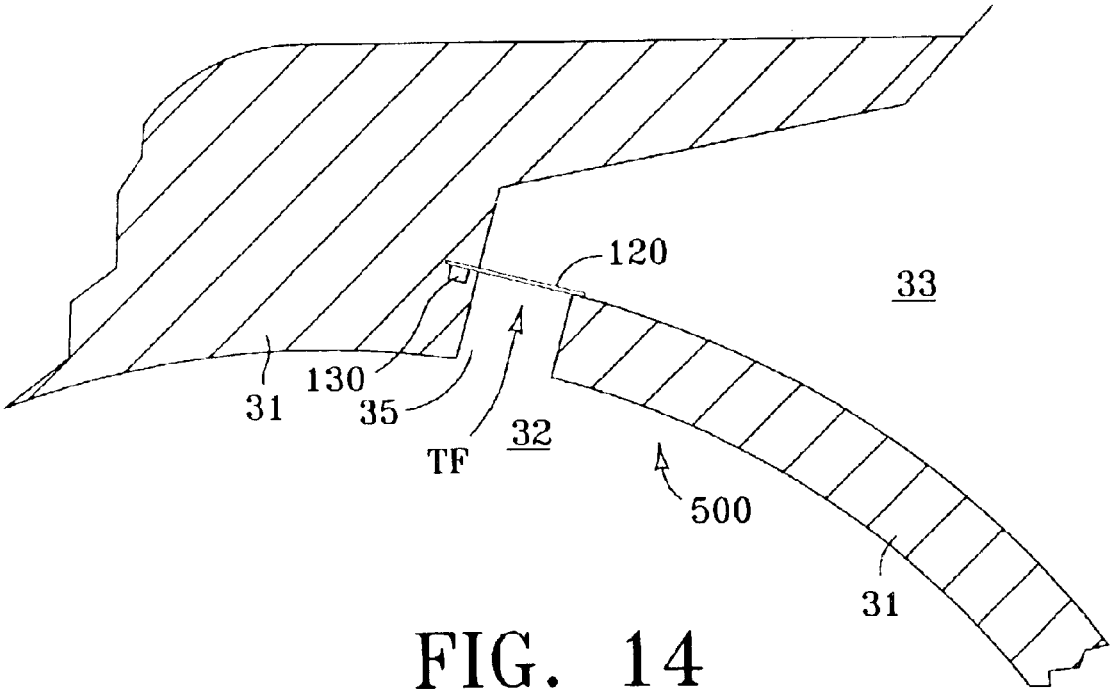
FIG. 14 is a side elevation sectional detail view of the toner cartridge depicted in FIG. 13, wherein the sealing member is shown in a closed position.

As is seen with reference to FIG. 14, toner flow TF from one chamber, such as the toner reservoir 32, to another chamber, such as the antechamber 33, can be selectively controlled by way of the sealing member 120 which can have a substantially blade form. The sealing member 120 can be operatively supported by the body 31 proximate the opening 35 defined therethrough. A heat source 130 can also be operatively supported by the body 31. The heat source 130 can be proximate the sealing member 120, and more specifically, the heat source 130 can be in contact with the sealing member.

Figure 15:
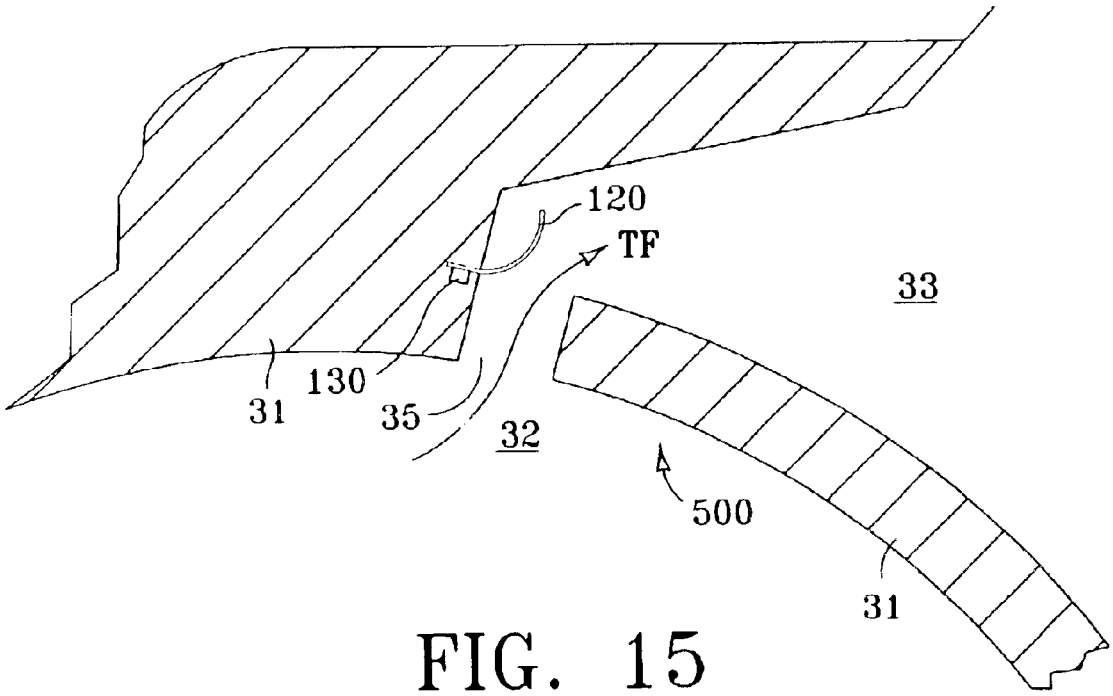
FIG. 15 is another side elevation detail view of the toner cartridge depicted in FIG. 13, wherein the sealing member is shown in an open position.

As is depicted in FIG. 14, the sealing member 120 is shown in a closed position, wherein the opening 35 is substantially blocked by the sealing member, and wherein toner flow TF through the opening is substantially prevented. With reference now to FIG. 15, another detail side elevation schematic detail view is shown in which the sealing member 120 along with a portion of the body 31 is depicted. As is seen, the view shown in FIG. 15 is substantially identical to that shown in FIG. 14. However, as depicted in FIG. 15, the heat source 130 has produced a given amount of heat energy which has been absorbed by the sealing member 120, thus causing thermal activation thereof.

In other words, as is seen with reference to FIGS. 14 and 15, the heat source 130 can produce heat energy which can be absorbed by the sealing member 120. Upon absorbing a given quantity of heat energy, the sealing member 120 can become thermally activated, whereby the sealing member changes shape and moves from a closed position to an open position. When in the open position, the sealing member 120 substantially unblocks the opening 35, thereby enabling toner flow TF through the opening. That is, thermal activation of the sealing member 120 can enable toner flow TF from one chamber (such as the toner reservoir 32) to another chamber (such as the antechamber 33) of the toner cartridge 500.

In accordance with a further embodiment of the invention, a method of controlling material flow through an opening includes providing a sealing member such as the sealing member 120 or the sealing member 420 which are discussed above. In accordance with the method, the sealing member is operatively disposed proximate the opening. When the sealing member is not thermally activated, the sealing member substantially blocks the opening, thus substantially preventing material flow therethrough. The method further includes providing heat energy to the sealing member, thereby thermally activating the sealing member, thereby causing the sealing member to unblock the opening.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A toner cartridge for containing a quantity of toner to be dispensed onto an optical photoconductor, the cartridge comprising a thermally activatable sealing member that is configured to control toner flow by selectively moving between a closed position and an open position in response to the absorption of heat energy.

2. The toner cartridge of claim 1, wherein the sealing member comprises:

a flexible member that is configured to absorb a quantity of heat energy, thereby causing the flexible member to change shape; and, an extension member operatively supported by the flexible member.

3. The toner cartridge of claim 2, wherein the sealing member comprises:

a hyper-expansive element; and, a hypo-expansive element connected thereto.

4. The toner cartridge of claim 3, wherein the hyper-expansive element and the hypo-expansive element are each substantially in sheet form and are oriented in parallel, juxtaposed relation to one another.

5. The toner cartridge of claim 4, wherein the hyper-expansive element and the hypo-expansive element are bonded to one another in a bi-layered manner.

6. The toner cartridge of claim 5, and further comprising a body which defines a toner reservoir and an opening through which the toner passes when dispensed onto the optical photoconductor, and wherein the sealing member is supported on the body and operatively disposed at the opening in facilitation of toner flow control therethrough.

7. The toner cartridge of claim 6, and wherein:

an antechamber is defined by the body;

the opening connects the toner reservoir to the antechamber; and, the sealing member is operatively disposed at the opening in facilitation of toner flow control between the reservoir and the antechamber.

8. The toner cartridge of claim 7, and wherein the optical photoconductor is operatively supported by the toner cartridge and within the antechamber.

9. An apparatus to selectively block and unblock an opening, the apparatus comprising:

a frame defining the opening; and, a thermally activatable sealing member that is configured to:

have a first shape corresponding to a first temperature of the sealing member; and, have a second shape corresponding to a second temperature of the sealing member, wherein:

at the first temperature, the sealing member substantially blocks the opening; and;

at the second temperature, the sealing member substantially unblocks the opening.

10. The apparatus of claim 9, and wherein the sealing member comprises:

a hyper-expansive element substantially in sheet form; and, a hypo-expansive element substantially in sheet form and bonded to the hyper-expansive element in a bi-layered manner, wherein the hyper-expansive element and the hypo-expansive element are oriented in substantially juxtaposed registration relative to one another.

11. The apparatus of claim 9, and wherein the sealing member comprises a flexible member that is fabricated from a material comprising a shape memory alloy.

12. The apparatus of claim 9, and wherein the sealing member comprises:

a flexible member that is configured to change shape in response to the absorption thereby of heat energy; and, an extension element connected to the flexible member.

13. The apparatus of claim 9, and further comprising a heat source operatively supported by the apparatus and configured to selectively supply heat energy to the sealing member, thereby causing the sealing member to operate.

14. The apparatus of claim 13, and wherein the heat source is in contact with the sealing member.

15. The apparatus of claim 14, and wherein the heat source is substantially in strip form.

16. The apparatus of claim 13, and further comprising a power source configured to selectively supply power to the heat source.

17. The apparatus of claim 16, and further comprising a switch configured to control the flow of power from the power supply to the heat source.

18. The apparatus of claim 9, and wherein the sealing member has a blade form.

19. The apparatus of claim 18, and further comprising an elastomeric coating that substantially surrounds the sealing member.

20. The apparatus of claim 9, and wherein the sealing member is in the shape of a cylindrical, overlapping roll form.

21. The apparatus of claim 20, and further comprising an elastomeric sheath that substantially surrounds the sealing member.

22. The apparatus of claim 20, and further comprising a heat source configured to supply heat energy to be absorbed by the sealing member, thereby causing the sealing member to operate, wherein the heat source is substantially surrounded by the sealing member.

23. A toner cartridge for containing a quantity of toner to be dispensed onto an optical photoconductor, the cartridge comprising:

a body which defines a substantially enclosed toner reservoir, wherein an opening is defined through the body, through which the toner passes when dispensed onto the optical photoconductor;

a thermally activatable sealing member supported by the body, wherein the sealing member is configured to substantially block the opening at a relatively low temperature of the sealing member, and that is further configured to unblock the opening at a relatively high temperature of the sealing member, the sealing member comprising:

a hyper-expansive element substantially in sheet form; and, a hypo-expansive element substantially in sheet form and bonded to the hyper-expansive element in a bi-layered manner, wherein the hyper-expansive element and the hypo-expansive element are oriented in substantially juxtaposed registration relative to one another.

24. The toner cartridge of claim 23, and further comprising a heat source supported on the cartridge, wherein the heat source is configured to supply heat energy to the hyper-expansive element.

25. The toner cartridge of claim 24, and wherein the heat source has a substantially sheet form and is bonded to the hyper-expansive element, the toner cartridge further comprising an electrical contact supported on the cartridge and electrically linked with the heat source, whereby external operational electrical power can be supplied to the heat source by way of the electrical contact.

26. The imaging device of claim 23, comprising an electrical contact supported by the body and electrically linked to the heat source, wherein operational electrical energy can be supplied to the heat source from the imaging device by way of the electrical contact.

27. A toner cartridge comprising:

a body; and, a thermally activatable sealing member supported by the body, wherein:

the toner cartridge is configured to be operatively supported by an imaging device; and, the sealing member is configured to operate by selectively moving between a closed position and an open position in response to the absorption thereby of energy supplied by the imaging device.

28. The imaging device of claim 27, and further comprising a heat source supported by the body and configured to supply energy in the form of heat to the sealing member, and wherein the energy supplied by the imaging device is in the form of electrical power.

29. The imaging device of claim 28, wherein:

the body defines a toner reservoir and an antechamber; and, the sealing member is configured to selectively control toner from the toner reservoir to the antechamber.

30. A method of controlling material flow through an opening, comprising:

providing a thermally activatable sealing member proximate the opening, wherein when not thermally activated the sealing member substantially blocks the opening, thus substantially preventing material flow therethrough; and providing heat to the sealing member, whereby the sealing member is thermally activated, thus causing the sealing member to substantially unblock the opening.

31. A sealing apparatus, comprising:

a frame defining an opening;

a thermally activated sealing member configured to operate in response to absorption thereby of heat energy, wherein the sealing member operates by moving between a closed position in which the opening is substantially blocked by the sealing member, and an open position in which the opening is substantially unblocked by the sealing member; and, a means for providing heat energy to the sealing member.

* * * * *